US005826437A

United States Patent [19]

Kim

[11] Patent Number: 5,826,437

[45] Date of Patent: Oct. 27, 1998

[54] REFRIGERATION FOR DISCHARGING COOL AIR FROM A DOOR

[75] Inventor: Hyung-Kwan Kim, Incheon, Rep. of Korea

[73] Assignee: Daewoo Electronics Co. Ltd., Seoul, Rep. of Korea

[21] Appl. No.: 870,446

[22] Filed: Jun. 6, 1997

[51] Int. Cl.[6] ..... F25D 23/02

[52] U.S. Cl. ..... 62/186; 62/426

[58] Field of Search ..... 454/195; 62/414, 62/419, 426, 186

[56] References Cited

U.S. PATENT DOCUMENTS

| | | | |
|---|---|---|---|
| 3,025,683 | 3/1962 | Baker et al. | 62/419 |
| 3,150,618 | 9/1964 | Rosenfeld | 454/195 |
| 4,368,622 | 1/1983 | Brooks | 62/419 |
| 5,319,937 | 6/1994 | Fritsch et al. | 62/426 |

*Primary Examiner*—William E. Tapoical
*Attorney, Agent, or Firm*—Beveridge, DeGrandi, Weilacher & Young, L.L.P.

[57] ABSTRACT

A refrigerator has a door duct installed inside a door and being formed with a cool air suction port and many cool air discharge ports which are opened at an inner surface of the door, and a blowing fan installed at the cool air suction port for supplying cool air in a fresh food compartment into the door duct. The cool air in the fresh food compartment is directed toward the door by the blowing fan, so the cool air is uniformly distributed in the fresh food compartment. Furthermore, the cool air drawn into the door duct is supplied into pockets formed inner side surface of the door through the cool air discharge port, so the inner space of the pockets are effectively cooled.

6 Claims, 4 Drawing Sheets

REFRIGERATION FOR DISCHARGING COOL AIR FROM A DOOR

BACKGROUND OF THE INVENTION

1. Field of the Invention

The present invention relates to a refrigerator for discharging cool air from a door, and more particularly to a refrigerator in which cool air in the cooling compartment is drawn into and supplied from a door duct which is installed inside the door.

2. Prior Art

FIG. 1 is a side sectional view of a conventional refrigerator. The refrigerator has a cabinet 10 forming a freezing compartment 21 and a fresh food compartment 22 which are partitioned from each other by a wall 27, and a freezing compartment door 24 and a fresh food compartment door 25 which open/close the freezing compartment 21 and fresh food compartment 22 respectively.

A compressor 23 is installed in a lower rear part of the cabinet 10, and an evaporator 29 for generating cool air by evaporating refrigerant supplied from the compressor 23 is installed in the rear of the freezing compartment 21. A cooling fan 19 for blowing the cool air generated by the evaporator 29 is installed at the upper side of the evaporator 29.

A plurality of cool air ports 16, 18 are formed at the rear walls of the freezing compartment 21 and the fresh food compartment 22. When the door 25 is closed, the cool air from the evaporator 29 is blown by the cooling fan 19 so as to be supplied into the freezing compartment 21 and the fresh food compartment 22, and accordingly the foodstuffs stored in the freezing compartment 21 and the fresh food compartment 22 are frozen and refrigerated respectively.

However, in such a conventional refrigerator, since the cool air is supplied from the rear side of the refrigerator, there is a problem that the cool air is not distributed uniformly in the fresh food compartment 22, so the foodstuffs stored in the fresh food compartment 22 may be overcooled or under cooled according to their location. In particular, according to the tendency for the refrigerator to become larger in size, it becomes harder to keep the temperature in the fresh food compartment 22 constant. Thus, a refrigerator adopting so called tri-dimensional fashion has been proposed, in which the cool air is discharged from side walls of the fresh food compartment 22 in addition to from the rear wall. In the tri-dimensional refrigerator, the maldistribution of the cool air has substantially been overcome.

However, such a tri-dimensional refrigerator is burdened with the problem that the area adjacent to the door cannot be cooled efficiently. When the door is opened, the area adjacent to the door, especially the inner spaces of pockets formed at the inner side surface of the door for accommodating foodstuffs, are in contact with outer air, so the temperature of such an area rises in a short time. In the tri-dimensional refrigerator, however, the area adjacent to the door and the inner spaces of pockets cannot be directly cooled, so the rapid and uniform cooling cannot be achieved. Therefore, a refrigerator for supplying the cool air from four side walls by supplying with cool air from the door has been proposed.

FIG. 2 is a transverse sectional view of a conventional refrigerator in a four-side discharging fashion. The refrigerator adopting the four-side discharging fashion has, a fresh food compartment duct 45 extended to the three side walls in the fresh food compartment 42, and a door duct 49 for providing passage for cool air in the door 47. The door duct 49 and the fresh food compartment duct 45 are connected with each other by a connecting pipe 50. The fresh food compartment duct 45 and the door duct 49 have a plurality of cool air discharge ports 53 opened toward the fresh food compartment 42. The cool air from an evaporator (not shown) is supplied into the fresh food compartment duct 45 and the door duct 49, and then the supplied cool air is discharged through the cool air discharge ports 53. Accordingly the cool air is discharged from the four side walls.

However, in such a conventional refrigerator, although the cool air is supplied into the area adjacent to the door and the inner spaces of the pockets, there is a problem that the sufficient effect to maintain the cooling intensity in the fresh food compartment 42 uniform cannot be achieved. In particular, in the state that the fresh food compartment 42 is full of foodstuffs, although the cool air is disposed from the four side wall, the flow of cool air is obstructed, and then the central part of the fresh food compartment 42 cannot be sufficiently supplied with the cool air. Furthermore, since the door 47 is manufactured independently with the cabinet 40, the connecting pipe 50 for connecting the door 47 with cabinet 40 is exposed outside, so the connecting pipe 50 may break down according to the use for a long time to bring about the leakage of the cool air.

SUMMARY OF THE INVENTION

The present invention has been proposed to overcome the above described problems in the prior art, and accordingly it is an object of the present invention to provide a refrigerator in which the area adjacent to the door in the cooling compartment and the inner spaces of the pockets formed at the door can be cooled rapidly, and the cool air can be distributed uniformly in the cooling compartment.

To achieve the above object, the present invention provides a refrigerator having a cabinet forming a cooling compartment, a door for opening/closing an opening of said cooling compartment, said refrigerator comprising: a door duct installed inside said door, said door duct being formed with a cool air suction port and a plurality of cool air discharge ports which are opened at an inner surface of said door; and a blowing fan installed at the cool air suction port for supplying cool air in said cooling compartment into said door duct.

Here, a means for sensing opening/closing of said door is installed in the refrigerator, and then said blowing fan is operated only when the closing of said door is sensed by said sensing means.

Moreover, in the cooling compartment, a means for sensing temperatures of an area adjacent to said door and an area distant from said door is installed, and then said blowing fan is controlled to operate when the temperature of the area adjacent to said door is higher than the temperature of the area distant from said door and when the temperatures in said cooling compartment sensed by said temperature sensing means are lower than a temperature corresponding to a cooling intensity which is set by a user.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the drawings.

Figure 1:
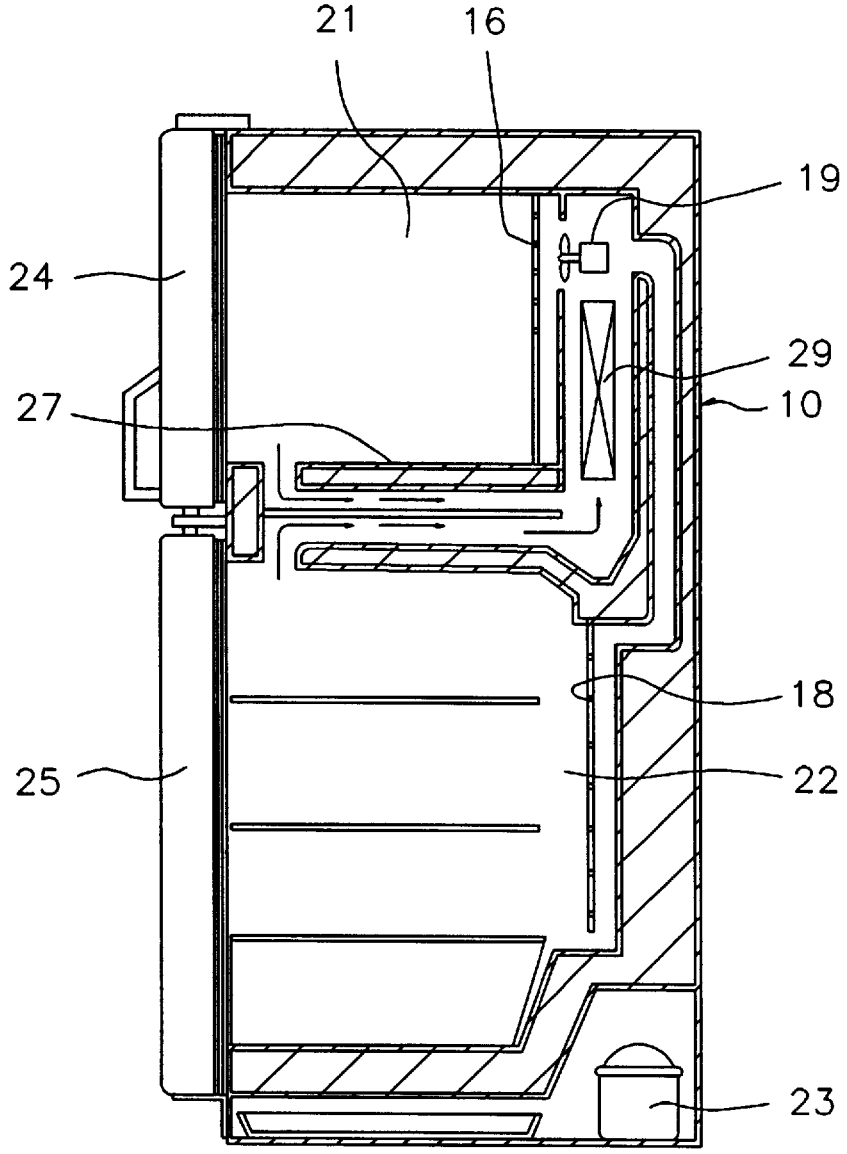
FIG. 1 PRIOR ART
FIG. 1 is a side sectional view of a conventional refrigerator.
Figure 2:
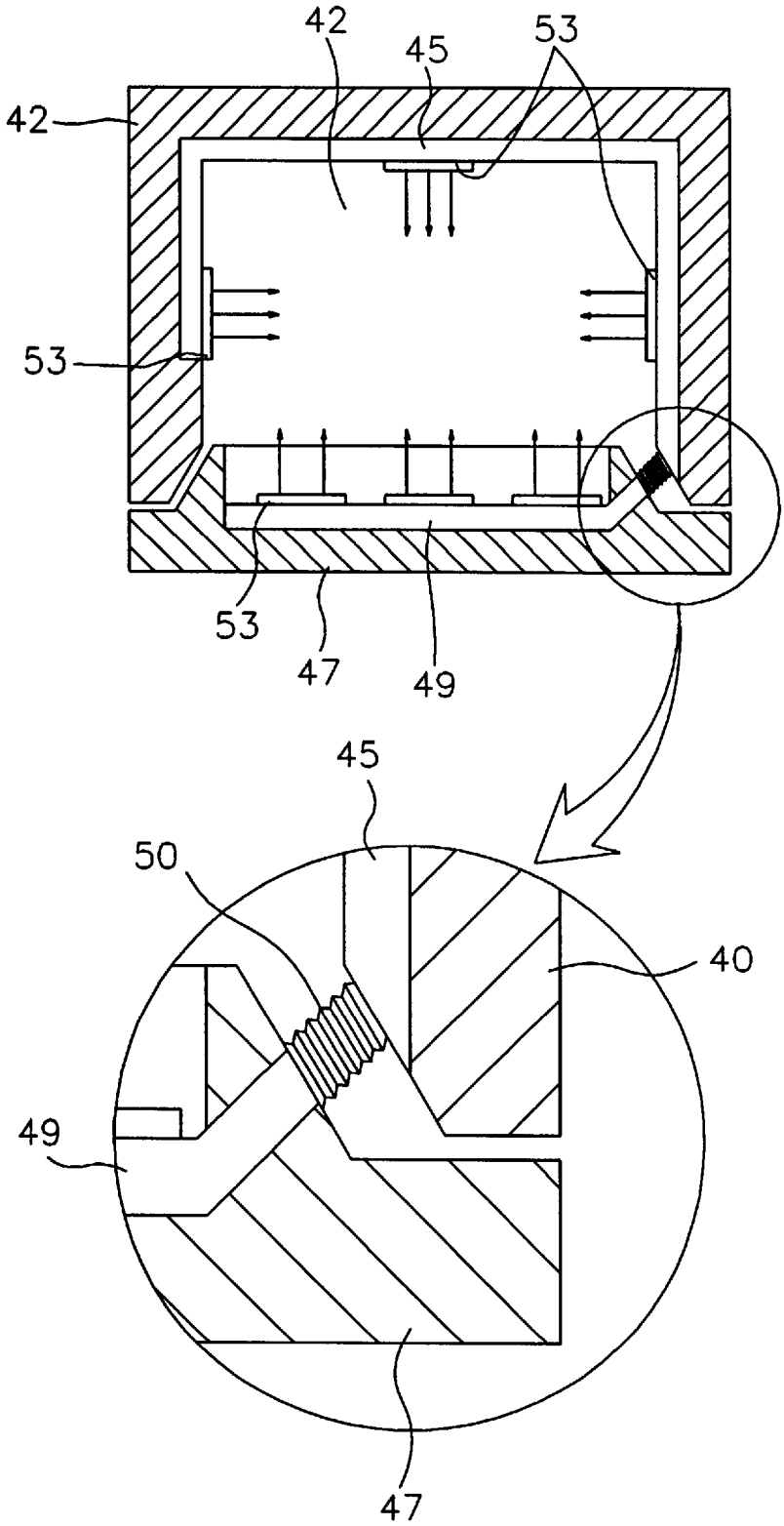
FIG. 2 is a transverse sectional view of a conventional refrigerator in a four-side discharging fashion.
Figure 3:
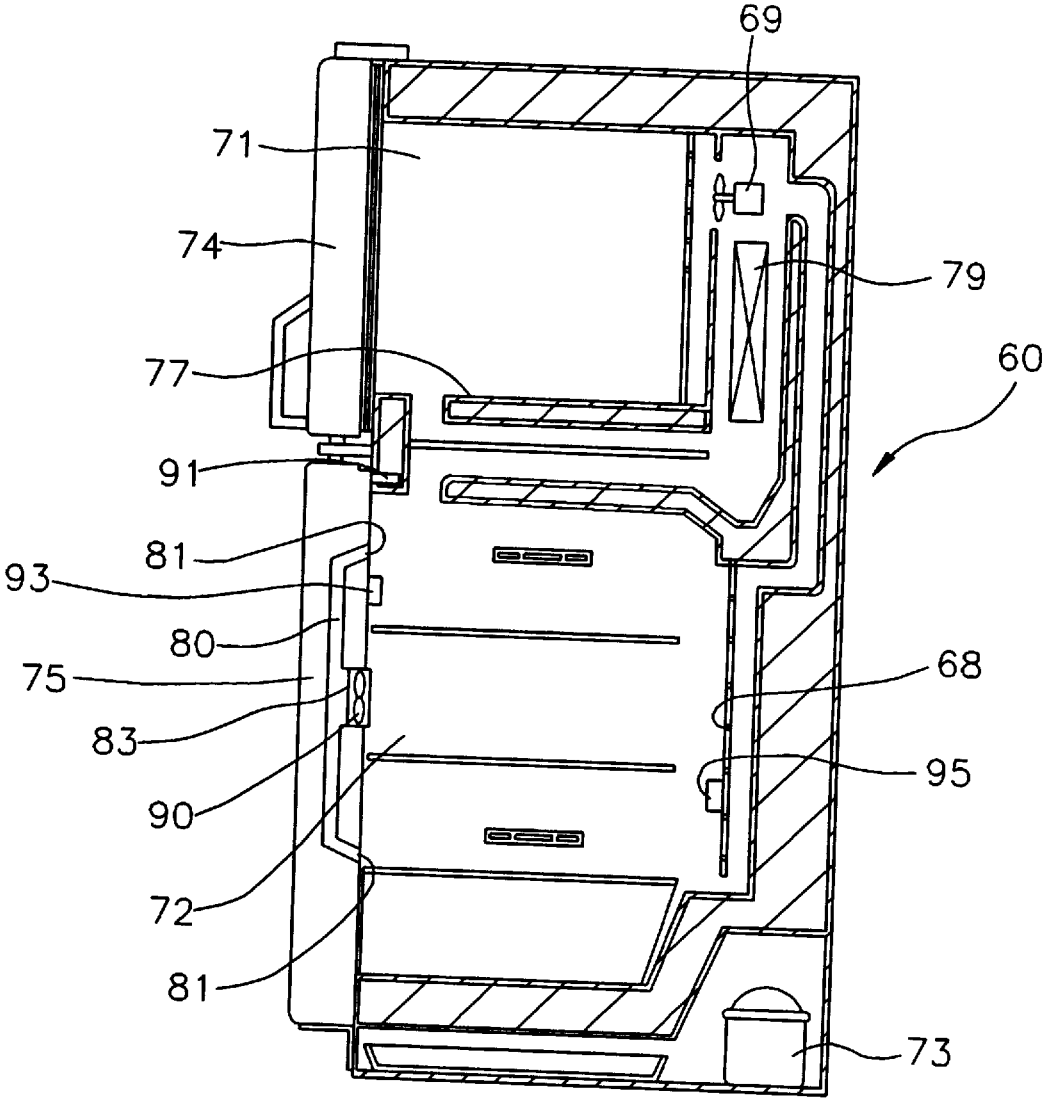
FIG. 3 is side sectional view according to the present invention.
Figure 4:
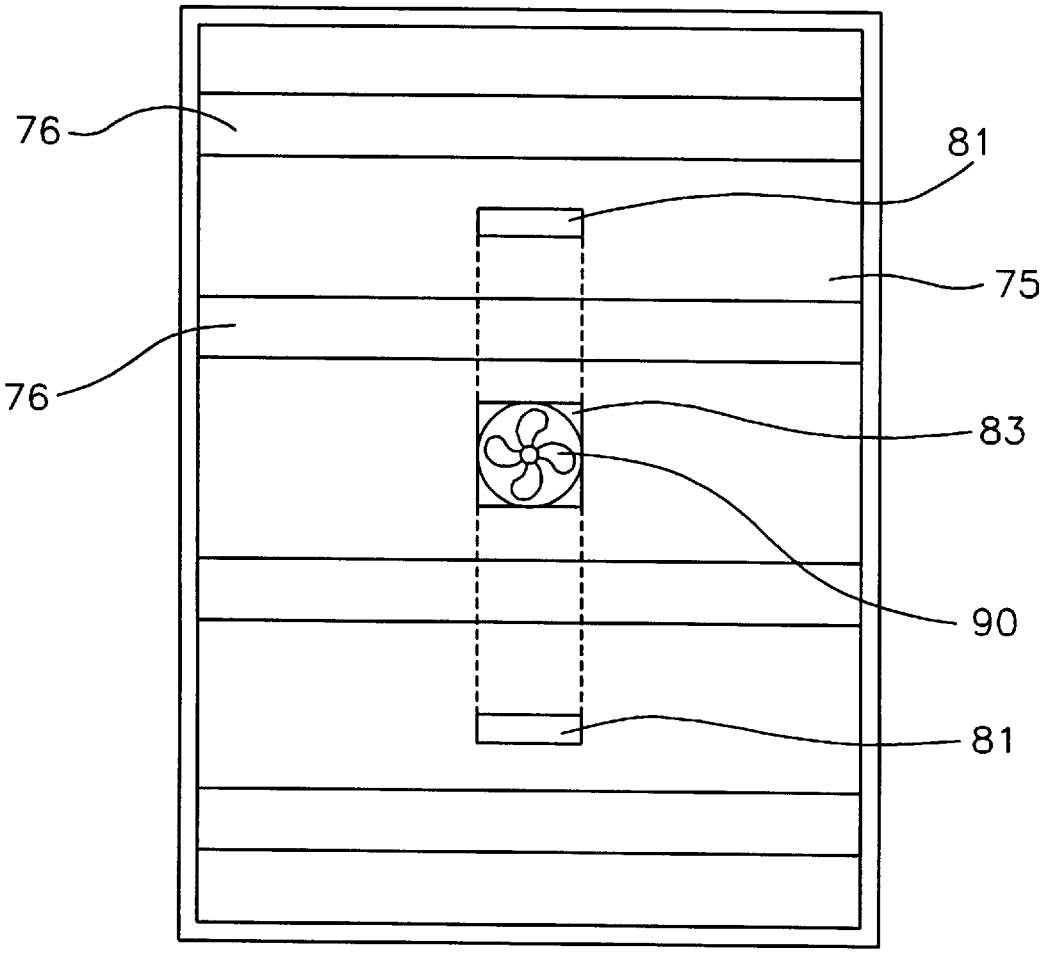
FIG. 4 is an inner side view of the door of the refrigerator in FIG. 3.

FIG. 3 is side sectional view according to the present invention, and FIG. 4 is an inner side view of the door of the refrigerator in FIG. 3. The refrigerator according to the present invention has, like the conventional refrigerator shown in FIG. 1, a cabinet 60 forming a freezing compartment 71 and a fresh food compartment 72 which are partitioned from each other by a wall 77, and a freezing compartment door 74 and a fresh food compartment door 75 which open/close the freezing compartment 71 and fresh food compartment 72 respectively.

Each door 74, 75 is hingedly mounted on the cabinet 60. At the inner side surface of the fresh food compartment door 75, pockets 76 for accommodating the foodstuffs are formed.

A compressor 73 is installed in a lower rear part of the cabinet 60, and an evaporator 79 for generating cool air by evaporating refrigerant supplied from the compressor 73 is installed in the rear of the freezing compartment 71. At the upper side of the evaporator 79, a cooling fan 69 for blowing the cool air generated by the evaporator 79 is installed so as to supply the freezing compartment 71 and the fresh food compartment 72 with the cool air.

A plurality of cool air ports 68 are formed at the rear walls of the fresh food compartment 72, and a plurality of ports (not shown) are formed at the side walls of the fresh food compartment 72. When the door 75 is closed, the cool air from the evaporator 79 is supplied into the fresh food compartment 72, and accordingly the foodstuffs stored in the fresh food compartment 72 are refrigerated.

A door duct 80 is installed inside the fresh food compartment 75. The door duct 80 is disposed along a vertical direction in the fresh food compartment door 75, and has a cool air suction port 83 which is opened at the center area of the fresh food compartment 75 and cool air discharge ports 81 which are opened at the upper part and the lower part of the fresh food compartment door 75. A blowing 90 fan is installed at the cool air suction port 83. The blowing fan 90 supplies the cool air in the fresh food compartment 72 into the door duct 80. The cool air supplied into the door duct 80 is discharged into the fresh food compartment through the cool air discharge ports 81.

A push button switch 91 is installed on the front surface of the fresh food compartment 72. The push button switch 90 is pushed by the door 75 when the door 75 is closed and released when the door 75 is opened. A microprocessor (not shown) installed in the refrigerator senses that the door 75 is opened when the push button switch 91 is released. The blowing fan 90 is operated when the closed door is sensed through the push button switch 91. Accordingly, the suction of the cool air through the cool air suction port 83 and the supply of the cool air through the cool air discharge ports 81 are performed only when the door 75 is closed.

Two temperature sensors 93, 95 are provided in the fresh food compartment 72. The temperature sensors 63, 65 consist of a door temperature sensor 93 disposed adjacently to the inner surface of the door 75 to sense the temperature at the area adjacent to the door 75 in the fresh food compartment 72, and a cooling compartment temperature sensor 95 disposed adjacently to the rear inner surface of the fresh food compartment 72 to sense the temperature at the area distant from the door 75 in the fresh food compartment 72. The temperatures sensed respectively by the two temperature sensors 93, 95 are inputted into the microprocessor. If the difference between the two temperatures sensed by the temperature sensors 93, 95 exceeds a predetermined value, in other words if the temperature at the area adjacent to the door 75 which is sensed by the door temperature sensor 93 is higher than the temperature at the rear area in the fresh food compartment 72 which is sensed by the cooling compartment sensor 95 at more than the predetermined value, the microprocessor drives the blowing fan 90 to supply the door duct 80 with the cool air.

Hereinbelow the operation and the effect of the refrigerator according to the present invention will be described.

When the push button switch 91 senses the door 75 is opened, the microprocessor stops operating the blowing fan 90 irrespective of the sensed temperatures by the temperature sensors 93, 95. When the push button switch 91 senses the door 75 is closed, the microprocessor operates the blowing fan 90 and the cooling fan 69 on the basis of the temperatures sensed by the temperature sensors 93, 95. That is, if the temperatures in the fresh food compartment 72 sensed by two temperature sensors 93, 95 are lower than a temperature corresponding to the degree of cooling set by a user, and if the sensed temperature by the door temperature sensor 93 is higher than the temperature in the fresh fool compartment 72 sensed by the cooling compartment door sensor 95 at more than a predetermined value, the blowing fan 90 and the cooling fan 69 operate. During that situation, the cool air is discharged from each wall in the fresh food compartment 72 through each cool air port 68, and the cool air drawn into the door duct 80 by the operation of the blowing fan 90 is discharged from the inner side surface of the door 75 through the cool air discharge ports 81 of the door 75. Therefore, the cool air is supplied from four sides, namely the rear wall, two side walls of the fresh food compartment 72, and the inner side surface of the door 75, into the fresh food compartment 72.

Since the blowing fan 90 sucks the cool air in the fresh food compartment 72, the cool air having been supplied from the inner sides of the fresh food compartment 72 is directed toward the door 75, and accordingly the cool air is uniformly distributed in the fresh food compartment 72. Also, since the cool air is supplied into the pockets 76 of the door 75 by the cool air discharged from the cool air discharge ports 81, the foodstuffs accommodated in the pockets 76 is refrigerated.

As described above, according to the present invention, since the cool air is supplied from the door, the area adjacent to the door in the cooling compartment and the inner space of the pocket formed at the door can be cooled rapidly, and the cool air can be uniformly distributed in the cooling compartment. Furthermore, since the additional connecting pipe for supplying cool air into the door is not required, the leakage of cool air due to the break down of the connecting pipe does not occur.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator having a cabinet forming a cooling compartment, a door for opening/closing an opening of said cooling compartment, said refrigerator comprising:

a door duct installed inside said door, said door duct being formed with a cool air suction port being disposed at a center area of said door and a plurality of cool air discharging ports being disposed at an upper area and a lower area of said door which are opened at an inner surface of said door; and a blowing fan installed at the cool air suction port for supplying cool air in said cooling compartment into said door duct.

2. The refrigerator as claimed in claim 1, further comprising a means for sensing opening/closing of said door, wherein said blowing fan is operated only when the closing of said door is sensed by said sensing means.

3. The refrigerator as claimed in claim 2, wherein said sensing means is a push button switch being pushed and released when said door is opened and closed respectively.

4. The refrigerator as claimed in claim 2, further comprising a means for sensing temperatures of an area adjacent to said door and an area distant from said door, wherein said blowing fan is controlled to operate when the temperature of the area adjacent to said door is higher than the temperature of the area distant from said door.

5. The refrigerator as claimed in claim 4, wherein said blowing fan is controlled to operated when the temperatures in said cooling compartment sensed by said temperature sensing means are lower than a temperature corresponding to a cooling intensity which is set by a user.

6. The refrigerator as claimed in claim 4, wherein said temperature sensing means comprises, a door temperature sensor disposed near said door in said cooling compartment; and a cooling compartment temperature sensor disposed at a side wall opposite said door in said cooling compartment.

* * * * *